US007521615B1

(12) United States Patent
Ho et al.

(10) Patent No.: US 7,521,615 B1
(45) Date of Patent: Apr. 21, 2009

(54) STRING TENSION ADJUSTMENT STRUCTURE

(75) Inventors: Tsung-Ming Ho, Taichung (TW); Chuan-Nen Shih, Changhua County (TW)

(73) Assignee: Ping Well Industrial Co., Ltd., Taichung (TW)

( * ) Notice: Subject to any disclaimer, the term of this patent is extended or adjusted under 35 U.S.C. 154(b) by 0 days.

(21) Appl. No.: 12/033,813

(22) Filed: Feb. 19, 2008

(51) Int. Cl.
*G10D 3/14* (2006.01)

(52) U.S. Cl. ..... 84/304

(58) Field of Classification Search ..... 84/304–306, 84/312 R

See application file for complete search history.

(56) References Cited

U.S. PATENT DOCUMENTS 4,589,321 A * 5/1986 Pritchard ..... 84/297 R

2007/0012158 A1* 1/2007 Kang ..... 84/304

* cited by examiner

*Primary Examiner*—Kimberly R Lockett

(74) *Attorney, Agent, or Firm*—Apex Juris, pllc; Tracy M Heims

(57) ABSTRACT

A string tension adjustment structure includes a dock, a winding axle longitudinally coupling with the dock that has an upper end fastened to a worm gear held in the dock and a lower end to wind a string, and a transverse rotary knob running through the dock that has a worm at one end to engage with the worm gear. The dock has a pair of insertion troughs to hold a U-shaped elastic reed. The elastic reed has a pair of clipping blades each has a notch at the top portion to clip an indented neck formed on the worm to anchor the rotary knob on the dock. The structure is simpler and fabrication and assembly are easier.

4 Claims, 5 Drawing Sheets

STRING TENSION ADJUSTMENT STRUCTURE

FIELD OF THE INVENTION

The present invention relates to a tuning machine of stringed instruments and particularly to a string tension adjustment structure that is simply constructed to save production cost.

BACKGROUND OF THE INVENTION

A conventional stringed instrument such as a guitar usually has a tuning machine to adjust the tension of strings (referring to FIG. 1). Refer to FIGS. 2, 3 and 4 for a conventional tuning machine of a guitar. It includes a hollow dock 1 which is extended longitudinally from the bottom to form a duct to couple with a winding axle 2. The winding axle 2 has an upper end coupled with a worm gear 3 held in the dock 1 and a lower side with a string hole formed thereon to be threaded through by a string for fastening. The dock 1 also has a transverse sleeve 4 to be run through a worm 5 to engage with the worm gear 3 to drive and turn the worm gear 3. The worm 5 has one end formed a coupling portion 5*a* which has two opposing planes. A rotary knob 6 is provided that has a through hole in the center that also has two opposing planes to couple with the coupling portion 5*a* of the worm 5. The rotary knob 6 is fastened to the worm 5 through a screw 5*b* from an outer side of the rotary knob 6 into a screw hole formed in the coupling portion 5*a*. The winding axle 2 has another screw hole 2*a* in the center of an upper end thereof to be fastened by another screw 7 to anchor the winding axle 2. The dock 1 has an opening 8 at the top to be sealed by a lid 9.

By turning the winding axle 6 the worm 5 can be rotated in a positive direction or a negative direction to drive the worm gear 3 to rotate in the positive or negative direction, and the string can be wound tighter or loosened as desired.

The conventional guitar tuning machine set forth above consists of a great number of elements. The worm 5 and rotary knob 6 have to be fabricated separately, then to be fastened through the screw 5*b*. The worm 5 and the through hole of the rotary knob 6 have to form two planes to make coupling and turning possible. Moreover, two washers have to be provided between the rotary knob 6 and the dock 1. All this increases fabrication process and production cost. The winding axle 2 further has to be fastened by another screw 7 to couple with the dock 1. As a result the cost and price are higher. And product competitiveness on the market suffers.

SUMMARY OF THE INVENTION

Therefore the primary object of the present invention is to provide a string tension adjustment structure to solve the problem of the conventional tuning machine of guitars that has too many elements and too high of production cost. The string tension adjustment structure according to the invention is constructed with a minimum number of elements in a simpler fashion, and can be fabricated at a lower cost.

To achieve the foregoing object, the string tension adjustment structure of the invention includes a hollow dock which has a circular housing compartment inside, a duct extended longitudinally downwards from a lower side of the dock to hold a winding axle, a worm gear held in the housing compartment to be coupled with an upper end of the winding axle which also has a string hole at a lower end to be threaded through by a string for fastening, and a transverse rotary knob running through the dock that has a worm at one end to engage with the worm gear. The dock further has a pair of insertion troughs to be wedged in by a U-shaped elastic reed. The elastic reed has a pair of upright coupling blades formed in an undulant manner. The coupling blades have respectively a notch at an upper side to clip an indented neck formed on the worm for anchoring. Thus the rotary knob can be anchored on the dock. The structure is simpler and can be fabricated and assembled easily. Production cost is lower and the competitiveness on the market can be enhanced.

By means of the structure set forth above, the neck of the worm can be clipped by the notch after the elastic reed is held in the insertion troughs so that the worm can be anchored on the dock. The winding axle has an angular strut at the upper end to be coupled with a polygonal hole formed in the center of the worm gear. The angular strut has a distal end which can be expanded by stamping to prevent the winding axle from slipping out. Fabrication and assembly are much easier, production cost is lower, and product competitiveness is higher.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 5:
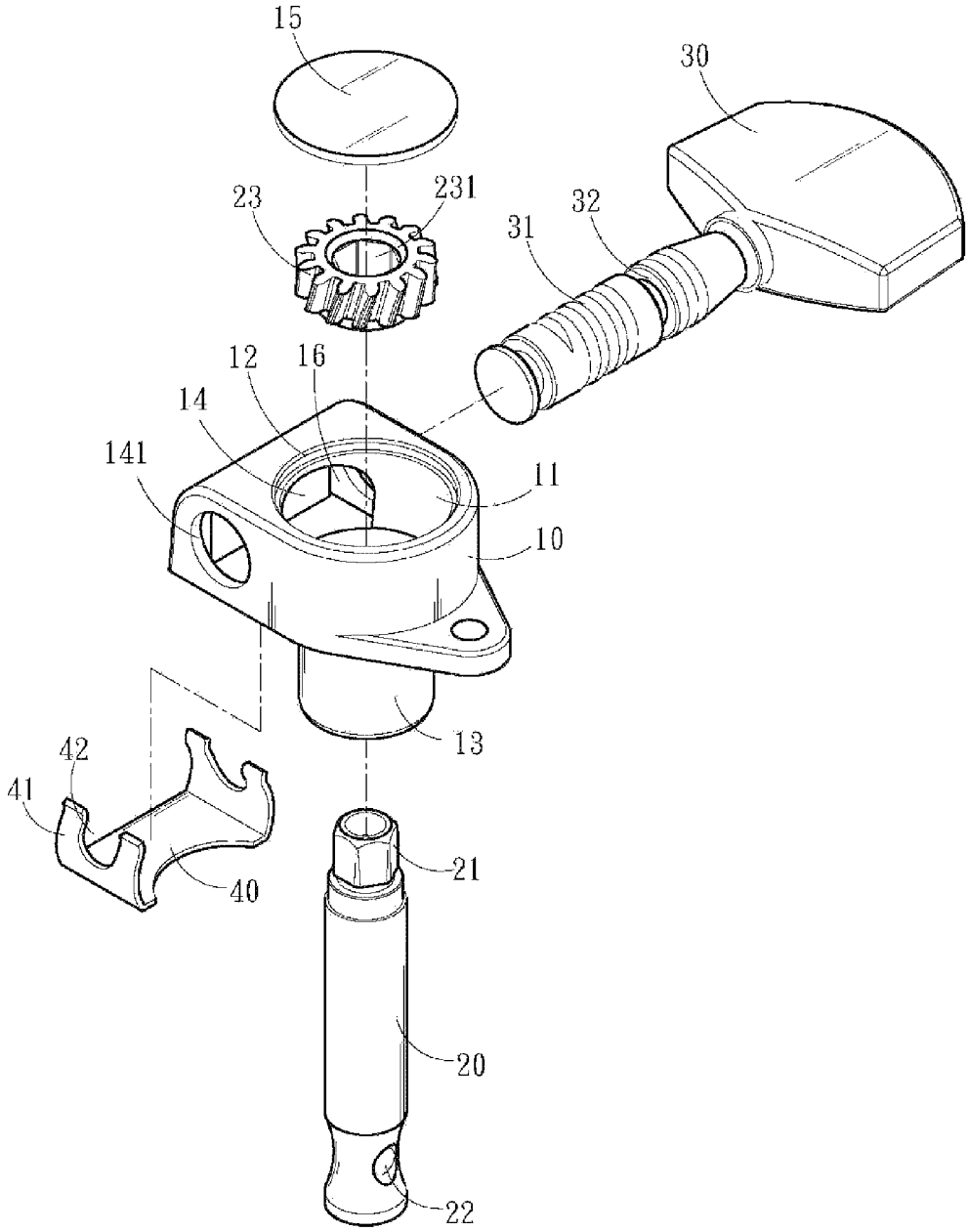
FIG. 5 is an exploded view of an embodiment of the invention.
Figure 7:
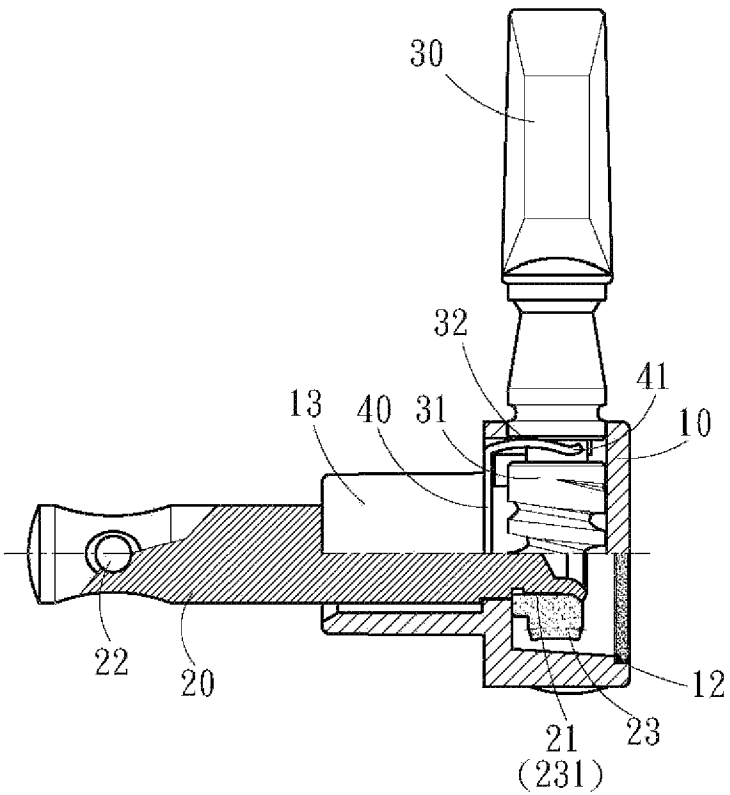
FIG. 7 is a sectional view of an embodiment of the invention.
Figure 6:
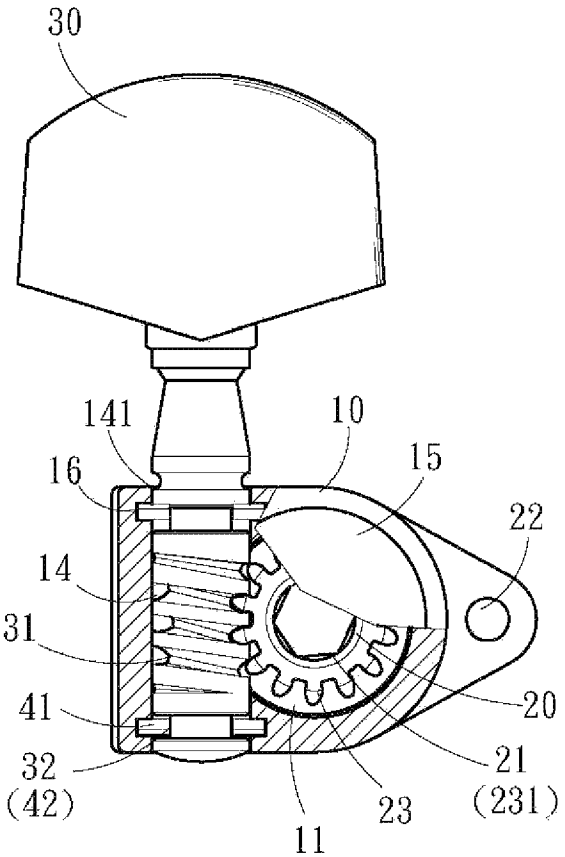
FIG. 6 is a top view an embodiment of the invention, partly cutaway.

Please refer to FIGS. 5, 6 and 7, the string tension adjustment structure according to the invention includes:

a dock 10 which has a circular housing compartment 11 inside leading to the top of the dock 10, a holding flange 12 at the top portion of the housing compartment 11, a circular duct 13 extended downwards from a lower side of the dock 10, and a transverse holding chamber 14 located at one side of the housing compartment 11 communicating therewith. The holding chamber 14 has a front wall and a rear wall each has a circular opening 141 opposing each other. A circular lid 15 is provided to rest on the holding flange 12 to seal the housing compartment 11. The front and rear walls of the holding chamber 14 have respectively an insertion trough 16 leading to the bottom of the dock 10 to form an opening;

a hollow winding axle 20 which runs through the duct 13 and has an angular strut 21 at an upper end and a transverse string hole 22 at a lower side to be threaded through by one end of a string (not shown in the drawings) of a stringed instrument such as a guitar for fastening. It also is coupled with a worm gear 23 which has a polygonal opening 231 in the center coupled with the angular strut 21;

a rotary knob 30 which has a flattened handle at one end and an extended worm 31 at another end to run through the two circular openings 141 of the dock 10. The worm 31 has two indented necks 32 at a front side and a rear side. The worm 31 is engaged with the worm gear 23 to drive and rotate the worm gear 23; and a U-shaped elastic reed 40 which has a pair of clipping blades 41 extended upwards from a front side and a rear side that are formed in an arched convex fashion directing inwards with the a top edge slightly extended outwards to become undulant. Each clipping blade 41 has a notch 42 at an upper side and is wedged in the insertion trough 16 of the dock 10 to be anchored. The indented neck 32 of the worm 31 is clipped by the notch 42 to allow the worm 31 to be coupled with the dock 10.

By means of the construction set forth above, when there is a desire to adjust the tension of the string, grasp the handle of the rotary knob 30 to turn the worm 31 in a positive or a negative direction; the worm gear 23 is driven to rotate synchronously and the winding axle 20 also is rotated due to coupling of the angular strut 21 and the polygonal opening 231, and tight fastening formed by stamping of the upper end of the winding axle 20 to expand outwards against the worm gear 23. As a result the string wound on the winding axle 20 can be tightened or loosened. By rotating the worm 31 one turn the worm gear 23 advances one tooth. Thus fine tuning of the string tension can be accomplished.

Figure 1:
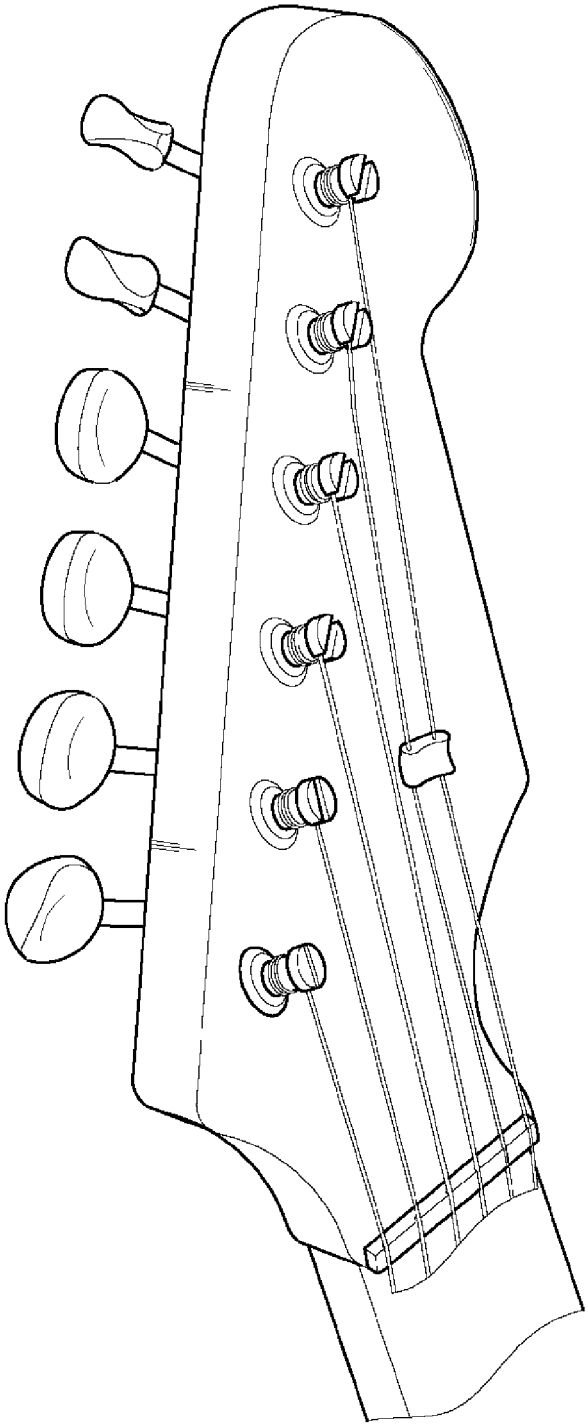
Fig. 1 PRIOR ART
FIG. 1 is a schematic view of a conventional tuning machine on a guitar.
Figure 2:
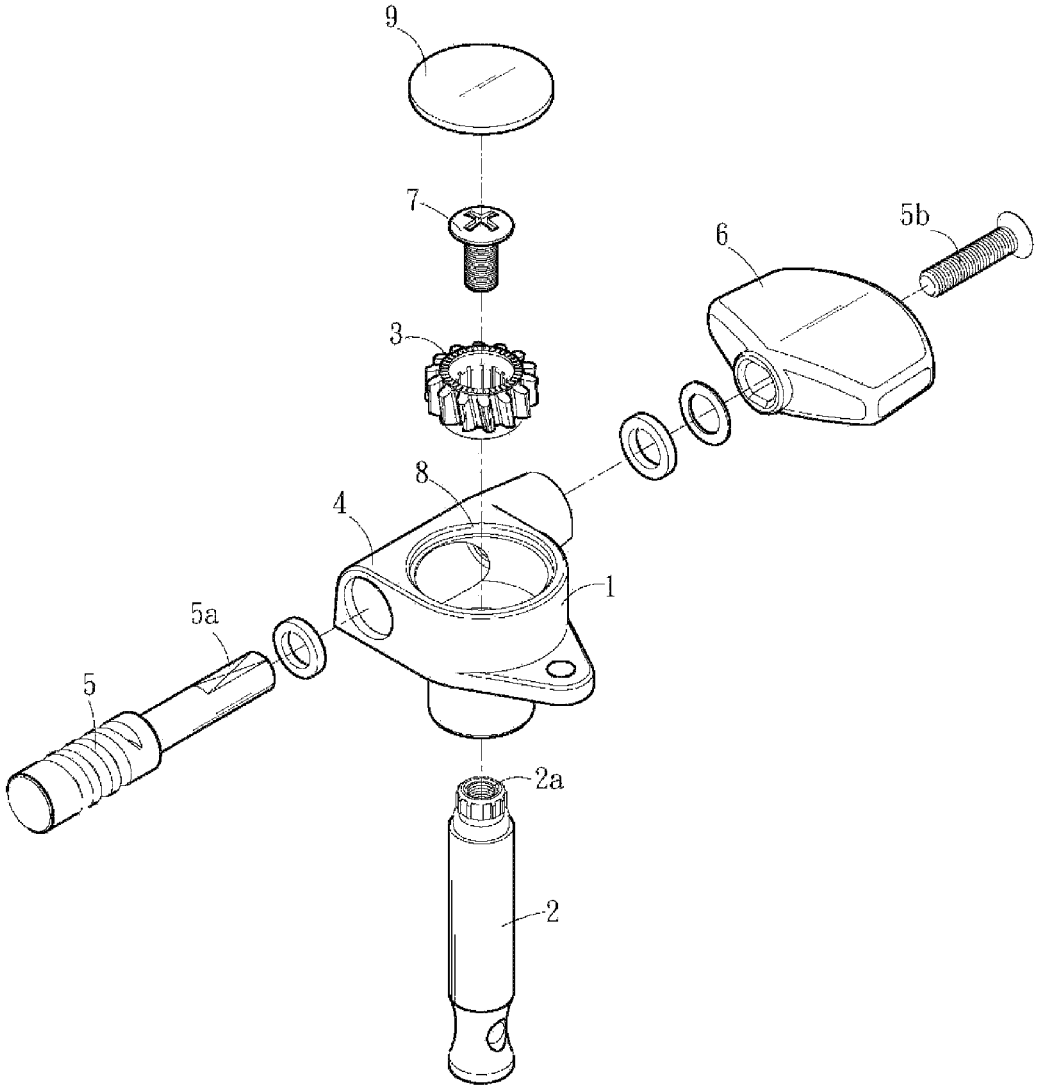
Fig . 2 PRIOR ART
FIG. 2 is an exploded view of a conventional tuning machine on a guitar.
Figure 4:
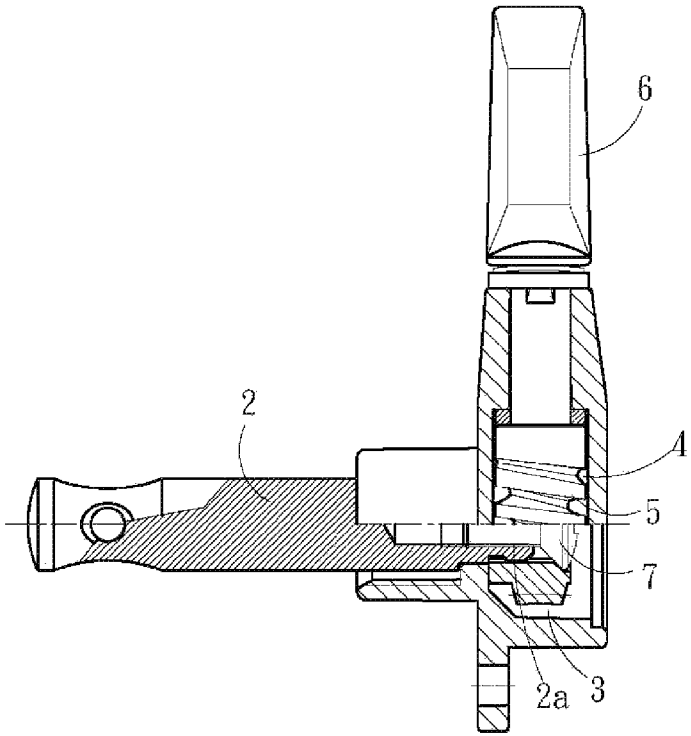
Fig. 4 PRIOR ART
FIG. 4 is a sectional view of a conventional tuning machine on a guitar.
Figure 3:
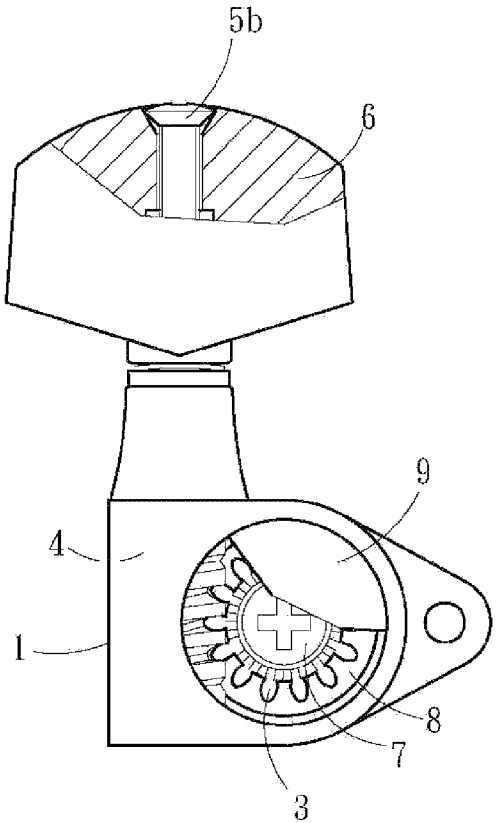
Fig. 3 PRIOR ART
FIG. 3 is a top view of a conventional tuning machine on a guitar, partly cutaway.

As the invention provides the elastic reed 40 with the undulant clipping blades 41 held firmly in the insertion troughs 16 of the dock 10, and the notch 42 clipping the indented neck 32 of the worm 31, the rotary knob 30 can be anchored securely on the dock 10. Compared with the conventional tuning machine of guitars as shown in FIG. 1, it saves two screws 5*b* and 7, two washers and fabrication process for forming the two planes at one end of the worm 5 and on the coupling portion 5*a*. The structure is simpler, fabrication and assembly are easier, and the production cost is lower.

Prototypes of the invention have been made according to the drawings and specification previously discussed. Test results indicated that the intended object and results are fully accomplished. It provides a significant improvement over the conventional products and techniques.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A string tension adjustment structure, comprising:

a dock which has a housing compartment inside and a holding chamber located at one side of the housing compartment, the holding chamber having a pair of insertion troughs and a front wall and a rear wall that have respectively a circular opening opposing each other;

a winding axle which runs through the dock from the bottom thereof and has an upper end coupling with a worm gear to be rotated synchronously therewith, the worm gear being held in the housing compartment, the winding axle having a transverse string hole at a lower side to be threaded through by a string of a stringed instrument for fastening;

a rotary knob which has a handle at one end and a worm extended from another end to run through the two circular openings of the dock, the worm having two indented necks at a front side and a rear side thereof and being engaged with the worm gear; and a U-shaped elastic reed which is wedged in the insertion troughs of the holding chamber and has a pair of clipping blades extended upwards from a front side and a rear side thereof that are formed in an arched convex fashion directing inwards with the a top edge extended outwards, each of the clipping blades having a notch at an upper side to clip the indented neck of the worm.

2. The string tension adjustment structure of claim 1, wherein the dock has a circular duct extended from a lower side thereof to hold the winding axle.

3. The string tension adjustment structure of claim 1, wherein the housing compartment of the dock leads to the top of the dock and has a holding flange at the top portion thereof to hold a lid to seal the housing compartment.

4. The string tension adjustment structure of claim 1, wherein the winding axle is hollow inside and has an angular strut at an upper end thereof, the worm gear having a polygonal opening in the center coupling with the angular strut, the upper end of the winding axle being expanded by stamping to fasten the worm gear.

* * * * *